US006012243A

United States Patent [19]

Ledford

[11] Patent Number: 6,012,243

[45] Date of Patent: Jan. 11, 2000

[54] GOODS DISPLAY FIXTURE

[76] Inventor: Janet K. Ledford, P.O. Box 1108, Duncan, Okla. 73534

[21] Appl. No.: 09/078,062

[22] Filed: May 12, 1998

[51] Int. Cl.[7] ..... G09F 15/00

[52] U.S. Cl. ..... 40/606; 40/607

[58] Field of Search ..... 40/606, 607, 611, 40/479, 506, 368, 369; 248/125.3, 125.1

[56] References Cited

U.S. PATENT DOCUMENTS

| | | | |
|---|---|---|---|
| 1,485,514 | 3/1924 | McGuire | 40/479 |
| 1,618,343 | 2/1927 | Kline | 40/479 |
| 2,625,762 | 1/1953 | McColl | 40/607 |
| 2,710,472 | 6/1955 | Leander | 40/479 |
| 5,561,931 | 10/1996 | Duenkel | 40/606 |

OTHER PUBLICATIONS

The revolver display fixture Jan West Sept. 1997 p. 2.
Revolver display unit Assembly Instructions JanCo, Inc. Sept. 1997 p.1.

*Primary Examiner*—Terry Lee Melius
*Assistant Examiner*—Rodrigo J. Morales
*Attorney, Agent, or Firm*—Thomas R. Weaver

[57] ABSTRACT

A method of and an apparatus for displaying goods is disclosed. The method pertains to the provision of a structure containing at least two parallel rails which define a plane area, wherein the rails are adapted to cooperate each with the other to mount and maintain in the plane area without fastening devices extraneous to the structure a rigid surface upon which is attached the goods to be displayed. The apparatus pertains to an example of a specific structure, and variations thereof, which is employed according to the method.

16 Claims, 7 Drawing Sheets

GOODS DISPLAY FIXTURE

BACKGROUND OF THE INVENTION

1. Field of the Invention

This invention broadly relates to an article of manufacture, referred to herein as a "fixture," useful for the display of goods. The invention further relates to a fixture for the display of clothing, and especially for the display of the portion of clothing, such as shirts, having designs, such as logos, symbols, slogans, messages and other marks, imprinted on the portion of the clothing to be displayed. This invention still further relates to a fixture for the simultaneous display of a number of T-shirts having a different design imprinted on each T-shirt, whereby a person desiring to acquire a T-shirt having a design imprinted thereon may conveniently view and compare the available designs in order to enhance and ease the selection of a T-shirt bearing a desired design.

2. Related Art and Problems Solved

A major problem which confronts a vendor of goods, particularly in a retail sales venue, involves the acquisition of sufficient and adequate space to display the goods for sale. The space, to be both sufficient and adequate, is preferably readily visually and tactilely accessible by potential buyers while not requiring the immediate attention of sales personnel and not occupying an excessive amount of limited floor area. In addition, such a sufficient and adequate space should maximize the vertical surface area available for display of goods while minimizing the occupation of floor area. The geometry of the display space should, preferably, enable the vendor of the goods to easily and rapidly place goods on and remove goods from the space without resort to the use of any fastening devices extraneous to the fixture itself.

Some retail venues rely on the planar areas of vertical walls for displaying goods. This display tactic does afford excellent visual, but not convenient tactile, access to the goods, and does not occupy valuable floor area. However, the quantity of vertical wall area available for the display of goods which is associated with any floor area is inherently limited, and, accordingly, commands a premium for its use. As a result, such area is usually reserved for the display of goods which command high retail prices.

Retail outlets also rely on floor-supported tables and cabinets to visually and tactilely display, as well as to store, goods. Such display fixtures can require a floor area equal to the display area and, thus, excessively occupy valuable floor space and require the close attention of retail sales personnel to supervise the handling of goods and to maintain a pleasing presentation of the display itself.

Retail outlets also employ racks from which clothing is suspended on hangers, usually in closely packed arrays. Such racks permit tactile access to the goods by a customer, but visual access to the goods is limited by the very fact that the goods are closely packed. Accordingly, for a buyer to select a good, such as a T-shirt, having a desirable design imprinted thereon, the buyer must remove each good from the rack for inspection in order to compare one design with another. This process can cause the goods to be improperly replaced in the rack and requires the close attention of sales personnel to maintain a pleasing and orderly display.

Other display space can involve the use of mannequins. While a mannequin does provide excellent visual and tactile opportunities for buyers, a mannequin, as a means of displaying a number of different goods, is hampered by the obvious inability to simultaneously display more than a single good of a given type. In short, a mannequin can only display one T-shirt at a time. Furthermore, since a mannequin occupies valuable floor area it becomes an inefficient vehicle for the display of a wide variety of goods whose principle distinctions reside in the design imprinted on the goods.

It is thus an object of this invention to provide a goods display fixture which features simultaneous visual access to a multiplicity of goods, such as T-shirts, having differing designs, whereby the planar area provided by the fixture for the display of the goods can be selected to be greater than the horizontal floor area actually occupied by the fixture. For the purposes of this disclosure and the appended claims, the ratio of the display area provided by the fixture to the horizontal floor area occupied by the fixture is referred to as the display efficiency.

It is another object of this invention to provide a method of and a fixture for securing and maintaining goods in the fixture without the need of fastening devices of any sort which are extraneous to the fixture itself.

SUMMARY OF THE INVENTION

This invention provides a fixture for and a method of displaying goods mounted on the fixture without need of fastening devices which are extraneous to the fixture itself. The method is broadly comprised of inserting display panels between facing angles defined by parallel rails, wherein each facing angle consists of a flange portion and a web portion which intersect to form a vertex angle of substantially about 90 degrees.

In one aspect, the above method is performed in connection with a fixture comprised of at least three elongated rails, wherein each rail consists of one web, at least one, and preferably, two, flange elements, an upper end and a lower end. The rails are equally spaced one from the other at the outer limits of the fixture and each is positioned parallel to, and equally spaced from, the longitudinal axis of the fixture, wherein each web of each rail is rigidly attached to the distal end of a radial extending from the axis of the fixture, whereby the flange element of each rail is substantially perpendicular to the distal end of the radial to which the web element is attached.

BRIEF DESCRIPTION OF THE DRAWINGS

FIG. 1 shows three display panels mounted in the fixture.

FIG. 3 is shown rotated 90 degrees in the clockwise direction from the vertical views, FIGS. 1 and 2. FIG. 3 is a top, plan view of the combination hub and vertical support bracket of the fixture.

FIG. 4 is a typical illustration of each of the four edges of the fixture as shown in FIG. 3 and shows the interaction between the edges of the fixture and display panels mounted therein.

FIG. 5 is taken through the longitudinal axis of the fixture from opposite sides of the fixture in the direction of cut line 2 of FIG. 1. Note the cover plate of the fixture is not shown in FIG. 5.

FIG. 6 is taken through the longitudinal axis of the fixture from opposite sides of the fixture in the direction of cut line 2 of FIG. 1.

FIG. 7 is taken through the longitudinal axis of the fixture from opposite sides of the fixture in the direction of cut line 2 of FIG. 1.

DESCRIPTION OF THE PREFERRED EMBODIMENTS

Figure 1:
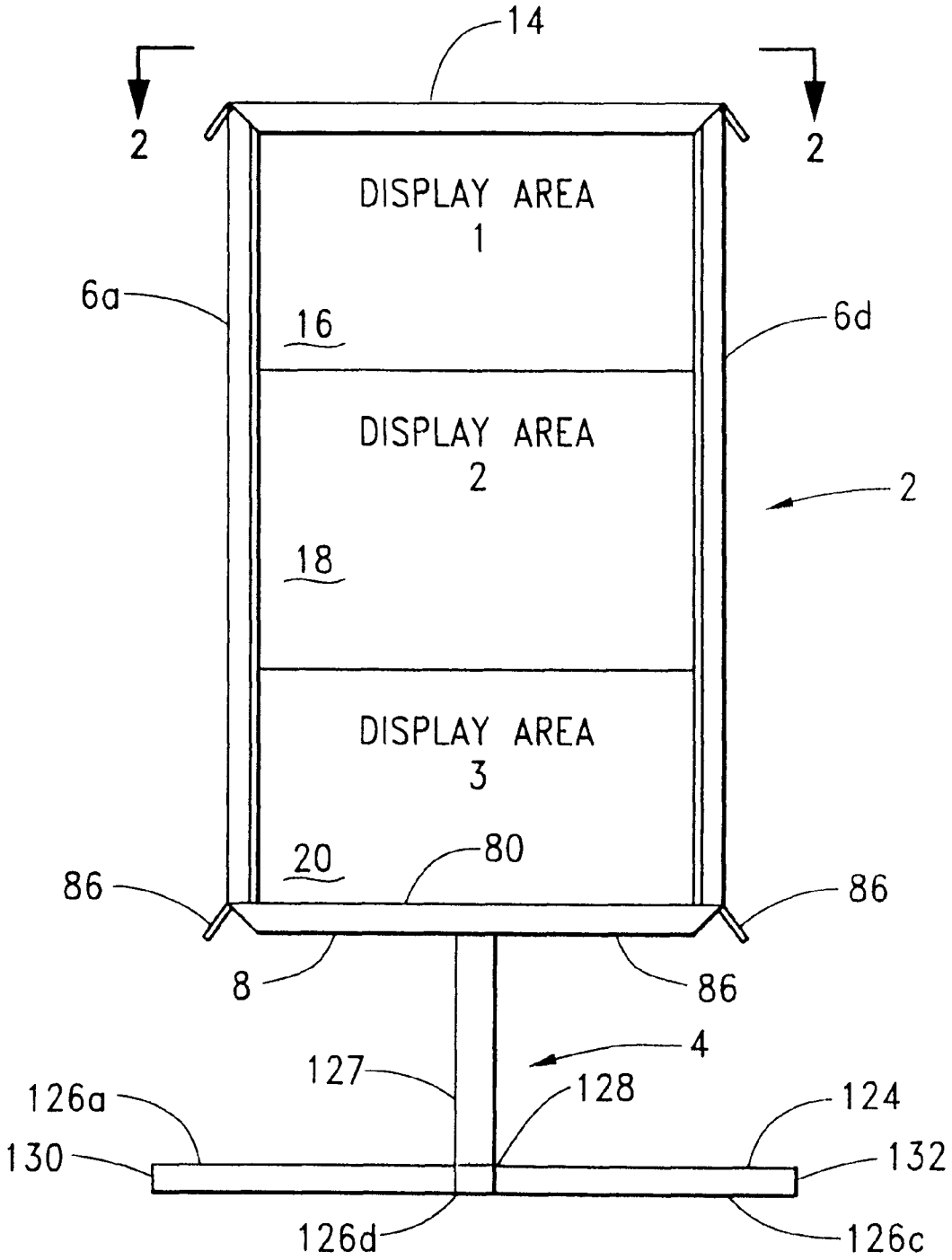
FIG. 1 is a front view of the exterior of a goods display fixture positioned vertically to a horizontal surface, wherein the horizontal cross section of the fixture, as shown in FIG. 3, is in the form of a regular polygon having four sides.

Referring now to the Figures, fixture 2 of this invention is shown positioned vertically to a horizontal surface and supported on the surface by support base 4. Fixture 2 comprises four mounting rails 6*a*, 6*b*, 6*c* and 6*d*, bottom cover plate 8, combination hub and vertical support bracket 10, top bracket 12, and top cover plate, 14. It is noted that fixture 2, in cross section, as seen in FIG. 3, is in the form of a regular polygon having four sides.

Figure 2:
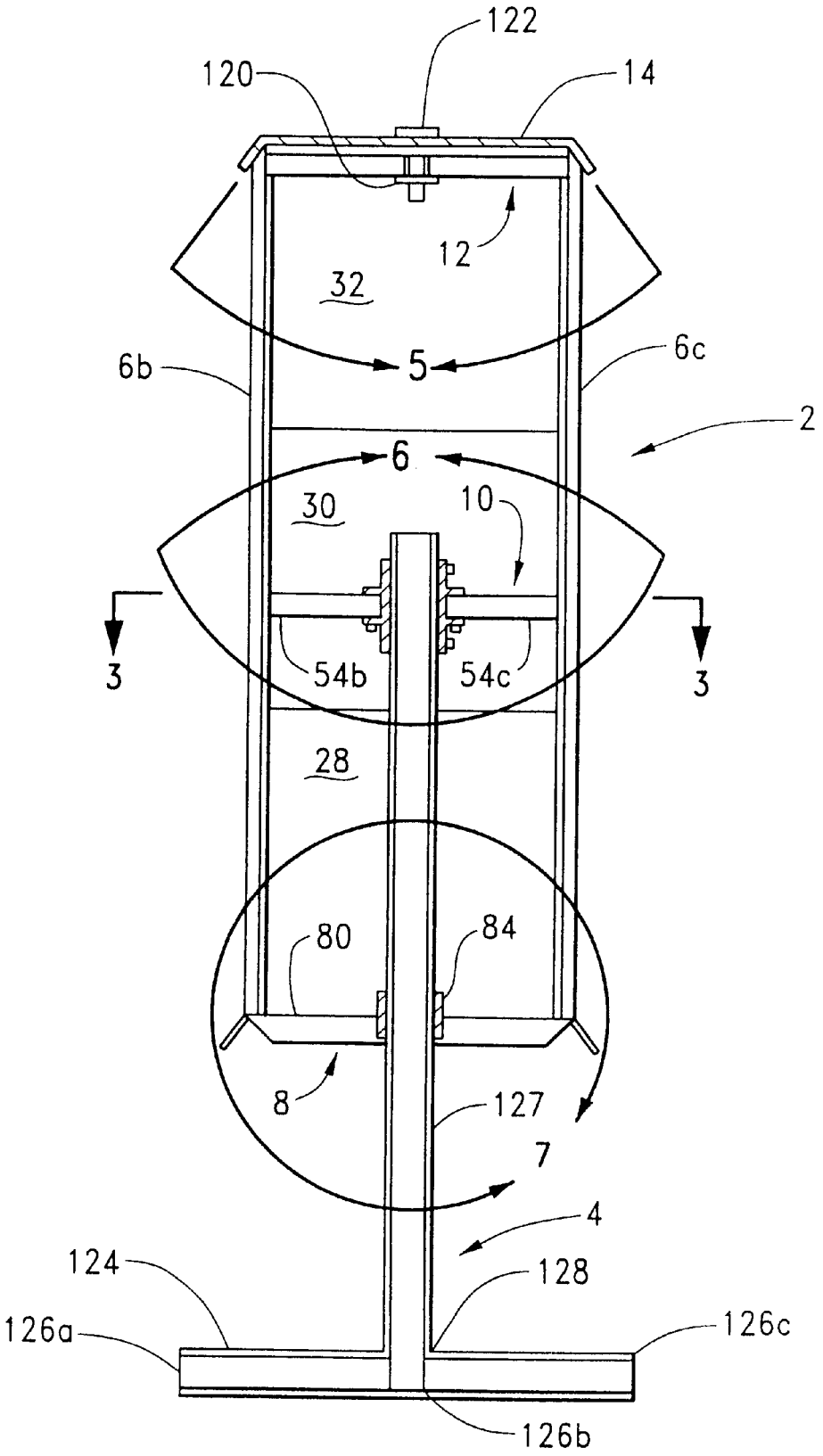
FIG. 2 is a vertical cross sectional view of FIG. 1 taken through the longitudinal axis of the fixture from opposite sides of the fixture in the direction of cut line 2 of FIG. 1.
Figure 5:
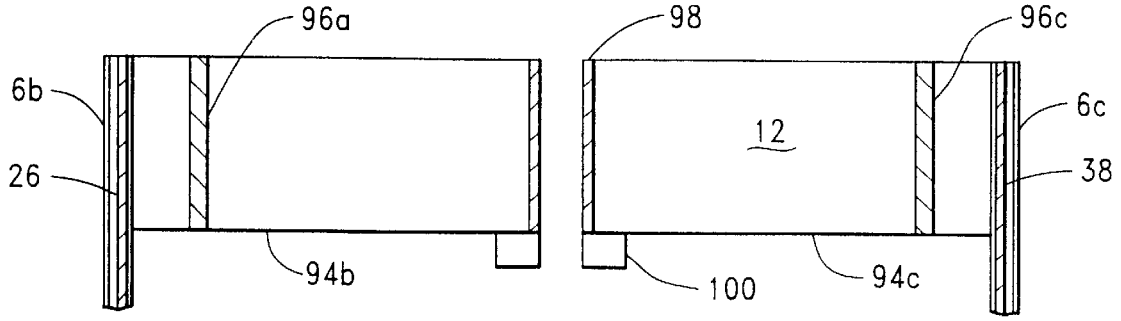
FIG. 5 is an expanded vertical detail view of the top of the fixture taken along cut line 5 of FIG. 2. It is noted, for purposes of clarity, that FIG. 5 is taken in the direction of cut line 6 as shown in FIG. 3. Accordingly.
Figure 6:
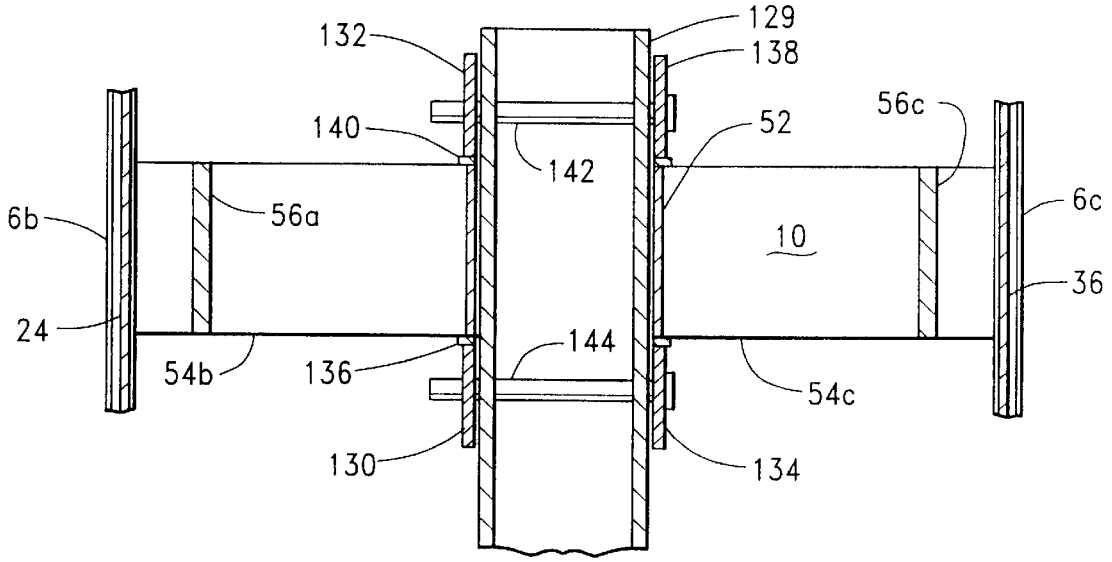
FIG. 6 is an expanded vertical detail view of the combination hub and vertical support bracket of the fixture taken along cut line 6*a* of FIG. 2. It is noted, for purposes of clarity, that FIG. 6 is taken in the direction of cut line 6 as shown in FIG. 3. Accordingly.
Figure 7:
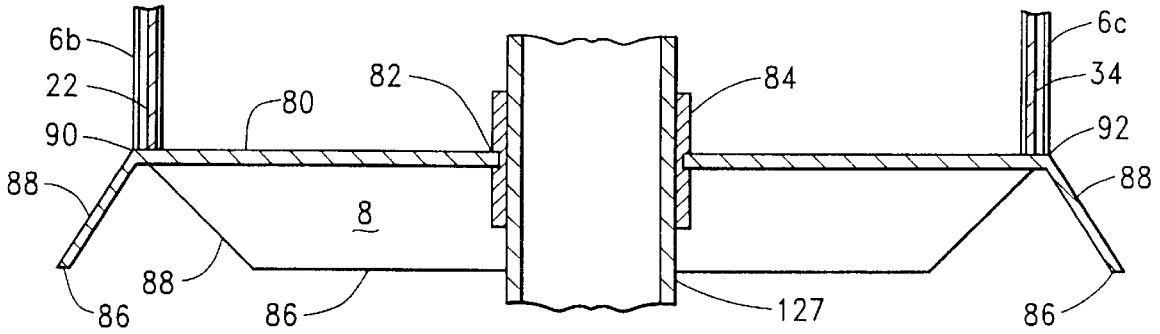
FIG. 7 is an expanded vertical detail view of the combination spindle guide and bottom support plate of the fixture taken along cut line 7 of FIG. 2. It is noted, for purposes of clarity, that FIG. 7 is take in the direction of cut line 6 as shown in FIG. 3. Accordingly.

The function of fixture 2 is to mount and maintain a plurality of panels in fixed positions to enable the display thereon of goods attached to the panels. Accordingly, display panels 16, 18, and 20 are shown positioned between mounting rails 6*a* and 6*d*. It is obvious that the exterior faces of panels 16, 18, and 20 are seen in FIG. 1. Cross sections of display panels 22, 24 and 26 are shown in FIGS. 5, 6 and 7 positioned between mounting rails 6*a* and 6*b*. Display panels 28, 30 and 32 are shown positioned between mounting rails 6*b* and 6*c*. It is obvious that the interior faces of panels 28, 30, and 32 are seen in FIG. 2. Cross sections of display panels 34, 36 and 38 are shown in FIGS. 5, 6 and 7 positioned between mounting rails 6*c* and 6*d*. Thus, by way of illustration, and not by way of limitation, fixture 2 is shown to have four display sides and twelve display panels to enable the simultaneous display of at least twelve different goods, such as twelve different T-shirts.

Figure 3:
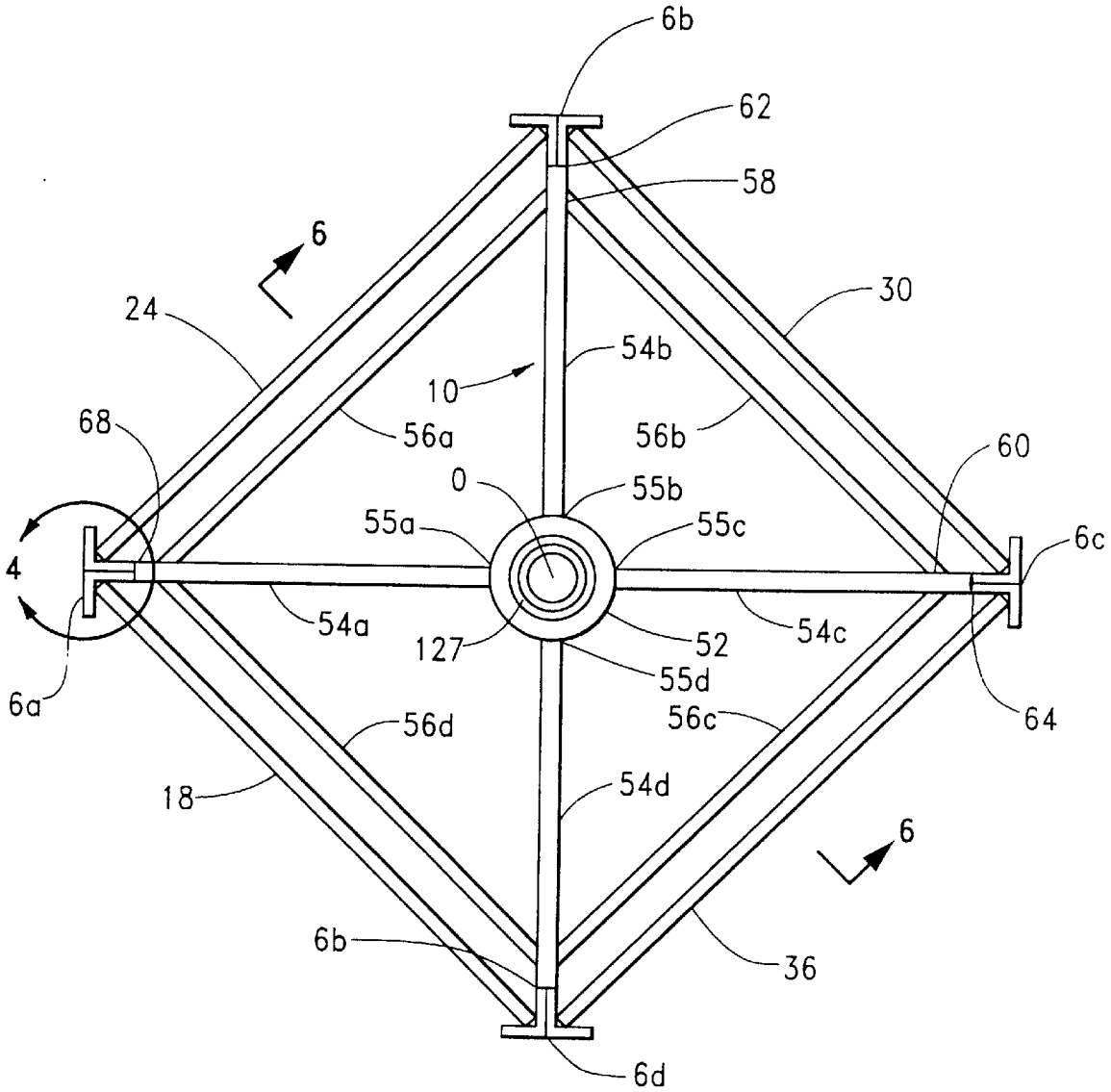
FIG. 3 is a top, horizontal cross sectional view of FIG. 1 taken along, and in the direction of, cut line 3 of FIG. 2.

Referring specifically to FIGS. 1, 2, 3 and 4, it is seen that mounting rails 6*a*, 6*b*, 6*c* and 6*d* are the outermost edges of fixture 2 and that each of the rails is an elongated member having a "T" shaped cross section consisting of two flanges and a web. It is further seen that the mounting rails are parallel each to the other, are equidistantly spaced each from the other around the edges of the fixture and are equidistantly spaced from the longitudinal axis of fixture 2, which such axis is represented in FIG. 3 by the point O. It is still further seen that the mounting rails are oriented so that the web of each rail faces inwardly toward the axis of Fixture 2.

Figure 4:
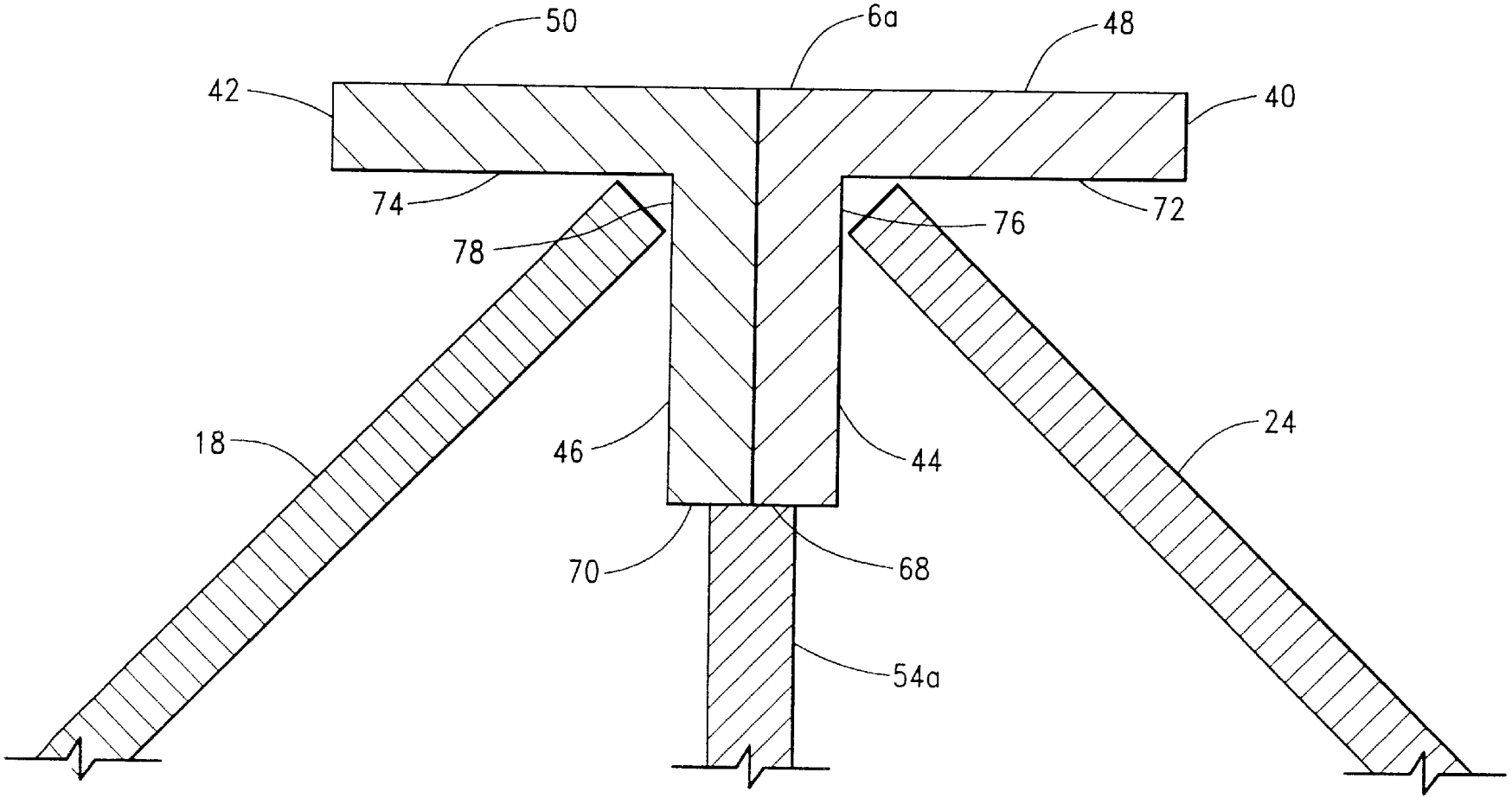
FIG. 4 is an expanded horizontal detail view of an edge of the fixture taken along cut line 4 of FIG. 3.

The above mentioned "T" shaped cross section of each mounting rail, as specifically illustrated in FIG. 4, which is an enlarged cross sectional detail of rail 6*a*, consists of two, elongated, L-shaped members, 40 and 42, rigidly joined, such as by welding, back-to-back, along webs 44 and 46, to thereby form a single, elongated, T-shaped member having a single web and two flanges 48 and 50. It is obvious that an equivalent of the joined L-shaped members is a single T-shaped member. Thus, for purposes of simplicity, the two joined webs 44 and 46 shall be referred to as web 44/46. As shall become more apparent herein below, web 44/46 and flanges 48 and 50 are important elements in the ability of fixture 2 to mount and maintain panels to thereby enable fixture 2 to perform its intended function.

Combination hub and vertical support bracket 10, for convenience referred to as central support bracket 10, includes hub 52, radial arms 54*a*, 54*b*, 54*c* and 54*d*, and radial arm support braces 56*a*, 56*b*, 56*c* and 56*d*. As seen in FIGS. 3 and 6, hub 52 is, preferably, a truncated, circular cylinder of uniform inside and outside diameter having a hollow interior. The axis of hub 52 is concentric with the longitudinal axis, O, of fixture 2. Accordingly, the center of hub 52, is coincident with axis 0 of fixture 2. The top surface of hub 52 is shown to lie in the same plane as the top surfaces of the radial arms, and the bottom surface of hub 52 is shown to lie in the same plane as the bottom surfaces of the radial arms. As shall be described herein below, fixture 2 is rotatable about axis 0 and such rotation can be enhanced by slightly extending the length of hub 52 above and below the planes of the top and bottom surfaces of the radial arms.

Radial arms 54*a*, 54*b*, 54*c* and 54*d*, are equal in length, are rigidly attached, such as by welding, at their proximal ends 55*a*, 55*b*, 55*c*, and 55*d* to the outer surface of hub 52 and extend substantially perpendicularly outward from hub 52 at 90 degree intervals. In this regard, the angle between adjacent radial arms, if the arms are extended to the point of intersection at axis O, is referred to herein as the central angle. The central angle is the result obtained by dividing 360 degrees by the number of sides in a regular polygon. Hence, the radial arms shown in FIG. 3 are spaced at 90 degree intervals around hub 52.

Radial arm support braces 56*a*, 56*b*, 56*c* and 56*d* are equal in length, are rigidly attached, such as by welding, at each of their ends to facing surfaces of adjacent radial arms between the proximal and distal ends of each radial arm. As shown in FIGS. 3 and 6, the points of attachment of the support braces are preferably closer to the distal ends of the radial arms than to the proximal ends of the radial arms in order to help maintain the above mentioned equidistant separation of the support rails. To illustrate the above, note that support brace 56*b* is attached at its opposite ends, 58 and 60, to facing vertical surfaces, not shown, of radial arms 54*b* and 54*c*, respectively, near the distal ends, 62 and 64, of radial arms 54*b* and 54*c*.

For purposes of design, the length of each radial arm support brace is the product of two multiplied by the sine of one-half the central angle multiplied by the distance from axis O to the desired point of attachment on a radial arm.

Having thus described central support bracket 10, the distal ends 62, 64, 66 and 68 of radial arms 54*b*, 54*c*, 54*d* and 54*a* are seen to be rigidly attached, such as by welding, to the interior facing surfaces of the webs of the corresponding mounting rails 6*b*, 6*c*, 6*d* and 6*a*. To illustrate, refer to FIG. 4, and observe that distal end 68 of radial arm 54*a* is rigidly attached to interior facing surface 70 of web 44/46 of mounting rail 6*a*. It is, thus, intended that radial arm 54*a* and web 44/46 form a substantially straight line perpendicular to hub 52 and that radial arm 54*b*, as seen in FIG. 6, is perpendicular to mounting rail 6*b*. In view of the above, it is obvious that flanges 48 and 50 of mounting rail 6*a* are substantially perpendicular to the straight line formed by the combination of radial arm 54*a* and web 44/46. The sum of the dimensions consisting of the radius of hub 52 to its outer surface, the length of radial arm 54*a,* and the length of web 44/46, as measured from the interior facing surface 70 to the interior facing surfaces 72 and 74 of flanges 48 and 50, respectively, is equal to the length of radius, "r," of a circle whose center is axis O. It is, thus, evident that flanges 48 and 50 are tangent to the thus defined circle at the end of the defined radius, r. Arms 54*b*, 54*c,* and 54*d* are attached to mounting rails 6*b,* 6*c* and 6*d* in exactly the same fashion as described with respect to rail 6*a* and arm 54*a*.

It is evident, from FIG. 4, that the intersection of interior face 72 of flange 48 with the adjacent side face 76 of web 44/46 and that the intersection of interior face 74 of flange 50 with adjacent side face 78 of web 44/46 each form angles of substantially 90 degrees. For purposes of description, these angles are referred to herein as "T" angles. It is, thus, clear that mounting rail 6*a* exhibits two such "T" angles. Similarly, the intersections of the corresponding adjacent flanges and webs of each of rails 6*b,* 6*c* and 6*d* also form two "T" angles. In this connection, and referring to FIG. 3, observe that each "T" angle of a mounting rail faces a "T" angle of an adjacent mounting rail. Thus, it is seen that one "T" angle of mounting rail 6*a* faces one "T" angle of mounting rail 6*b* and that the second "T" angle of mounting rail 6*a* faces one "T" angle of mounting rail 6*d*. Note, further, that at least one display panel can be mounted between each pair of facing "T" angles. Accordingly, note that display panels 16, 18, and 20 are mounted between facing "T" angles of rails 6*a* and 6*d*; that display panels 22, 24, and 26 are mounted between facing "T" angles of rails 6*a* and 6*b*; that display panels 28, 30, and 32 are mounted between facing "T" angles of rails 6*b* and 6*c*; and that display panels 34, 36, and 38 are mounted between facing "T" angles of rails 6*c* and 6*d*. Also, note that no fastening devices of any kind extraneous to fixture 2 are employed to secure in place any of the display panels mounted between facing "T" angles.

As stated above, fastening devices extraneous to the fixture are not required to mount and maintain display panels in position between facing "T" angles. In this regard, the panels are maintained in place due to interaction between the component parts of each pair of facing "T" angles and the display panel being held between such pair. The interaction referred to operates to retain the panel edges within the confines of the flanges and web of each mounting rail. Factors which contribute to this interaction include the linear dimensions of the flanges and web of each rail, the angles between the panel and an adjacent flange and web and the width and stiffness of the panel itself.

Accordingly, note FIGS. 3 and 4 and observe that each "T" angle consists of two complimentary, component angles, one of which is referred to herein as the "interior" angle, and the second of which is referred to herein as the "tangent" angle, wherein the interior angle is the acute angle formed at the intersection of web 44/46 and, for example panel 24, and the tangent angle is the acute angle formed at the intersection of flange 48 and, for example panel 24. Similarly, interior angles and tangent angles are also formed between the panels and rails named in the preceding paragraph. It is important to note that each display panel maintained in the fixture is associated with two tangent angles and two interior angles and that, because the horizontal cross section of the fixture, as seen in FIG. 3, is in the form of a regular polygon, every interior angle is equal in size to every other interior angle and that every tangent angle is equal in size to every other tangent angle. It is evident that the tendency of a mounted panel to fall into the interior of the fixture increases as interior angles become larger, i.e., less acute, and, conversely, that the tendency of a panel to fall away from the interior of, and thus to fall off, the fixture increases as tangent angles become larger, i.e., less acute. It is also evident, due to the complimentary nature of the interior and tangent angles, that as one of the angles increases in size the other angle decreases in size.

A polygon, by definition, must have at least three sides. Therefore, the largest tangent angle which can be encountered by any fixture of this invention, having a cross section based on a regular polygon, is 60 degrees which would occur only in the case of a regular polygon of three sides. It is, thus, believed that the interior angle is the most critical of the two angles, in that the interior angle increases as the number of sides of the fixture increases. Because of the effect of the size of the angles, particularly the interior angle, on the ability of the fixture to retain panel edges within the confines of the flanges and web of each mounting rail, it is believed that the practical useful limit for the number of sides of a fixture useful in this invention is 15, in which case the size of the interior angle is 78 degrees.

In addition to the above discussed angular limits of the "T" angles, flange 48 should be of sufficient length to prevent the panel from falling away from the fixture and web 44/46 should be of sufficient length to prevent the panel from falling into the interior of the fixture.

In an ideal sense, the display panel is, preferably, highly inflexible in the direction perpendicular to axis O, that is, it should resist bending both toward and away from the axis of FIG. 2 and, further, the width of the panel is, preferably, substantially equal to the distance separating the vertices of the facing "T" angles between which it is placed.

For design purposes, the maximum width of a display panel, such as panel 24, can be estimated as being the product obtained by multiplying the previously defined radius, r, by two times the sine of one-half the central angle. Furthermore, this product is referred to herein as the display width of the fixture.

Referring to FIG. 7, it is seen that bottom cover plate 8 serves to maintain the orientation and the angular and spacial separation of mounting rails 6*a,* 6*b*, 6*c* and 6*d* as described above in connection with central support bracket 10. In addition, bottom cover plate 8 contains hole 82 in the center thereof which penetrates surface 80 of bottom cover plate 8. The center of hole 82 is in alignment with the axis of fixture 2 and the diameter of hole 82 is of a size sufficient to permit the insertion through surface 80 of hollow cylinder 84, having an inside diameter equal to the inside diameter of hub 52. The portion of cylinder 84 which extends below surface 80 does not extend below the plane of bottom surfaces 86 of skirts 88 which are attached to and flair, that is, extend outwardly and downwardly, from the edges of surface 80 of cover plate 8.

The bottom of each mounting rail is rigidly attached, such as by welding, to the top surface 80 of bottom plate 8 at the corners thereof so that surface 80 is parallel to radial arms 54 and the edges of surface 80 are in alignment with the outer limits of the flanges of each mounting rail. Note, for example, in FIG. 7 that the flanges of mounting rails 6*b* and 6*c* are in alignment with edges 90 and 92, respectively, of bottom cover plate 8. Note further in FIG. 7, that edges 90 and 92 of surface 80 extend slightly beyond the outside surfaces of display panels 22 and 34, respectively. Accordingly, it is evident that surface 80 provides the ultimate bottom support for all display panels mounted in fixture 2. It is, thus, clear that skirts 88 not only provide a decorative feature to fixture 2, but also serve to help stiffen the structure in that the entire weight of the panels and the displayed goods is transferred to the outer edges of bottom cover 8.

Top bracket 12, except as specifically noted below, is identical in all respects to central support bracket 10. The various elements of bracket 10, together with their description and operation, are repeated in top bracket 12. Accordingly, with respect to FIG. 5, radial arms 94*a* (not shown), 94*b*, 94*c* and 94*d* (not shown), and radial arm support braces 96*a*, 96*b* (not shown), 96*c* and 96*d* (not shown) occur and operate as described in bracket 10 with respect to arms 54 and braces 56.

Arms 94 are attached to mounting rails 6, as described in connection with bracket 10, except that the specific points of attachment, as shown in FIG. 5, are adjusted such that the top surfaces of arms 94 lie in the same plane as the top surfaces of rails 6.

Hub 98 is a truncated, circular cylinder of uniform inside and outside diameter having a hollow interior. The axis of hub 98 is concentric with the longitudinal axis, O, of fixture 2. Accordingly, the center of hub 98, is coincident with axis 0 of fixture 2. The top surface of hub 98 lies in the same plane as the top surfaces of radial arms 94, and the bottom surface of hub 98 lies in the same plane as the bottom surfaces of radial arms 94. The diameter of hub 98 is less than the diameter of hub 52. Threaded nut 100 is rigidly attached to the bottom surface of hub 98. The axis of nut 100 is concentric with the longitudinal axis of fixture 2.

An important feature of the fixture of this invention is the vertical dimension available for the display of goods, which is referred to herein as the display height. For purposes of design, the display height of the fixture of this invention is the distance from the top of surface 80 of bottom cover plate 8, as shown in FIG. 7, to the top of radial arms 94 as shown in FIG. 5.

Accordingly, the total area provided by the fixture for the display of goods is the product of the number of sides of the fixture, the display height and the display width.

Figure 8:
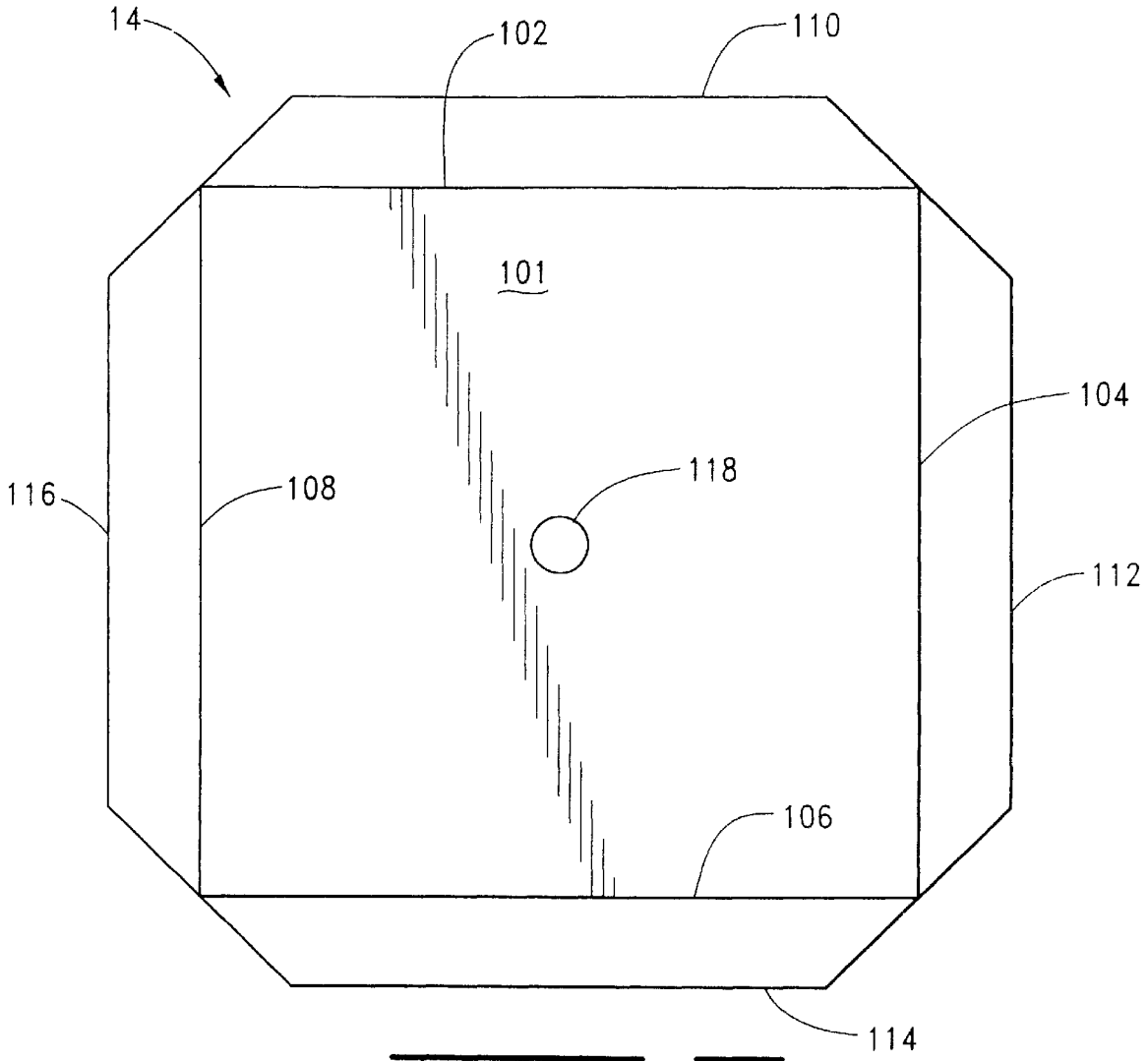
FIG. 8 is the top view of the fixture showing the top cover plate thereof.
Figure 9:
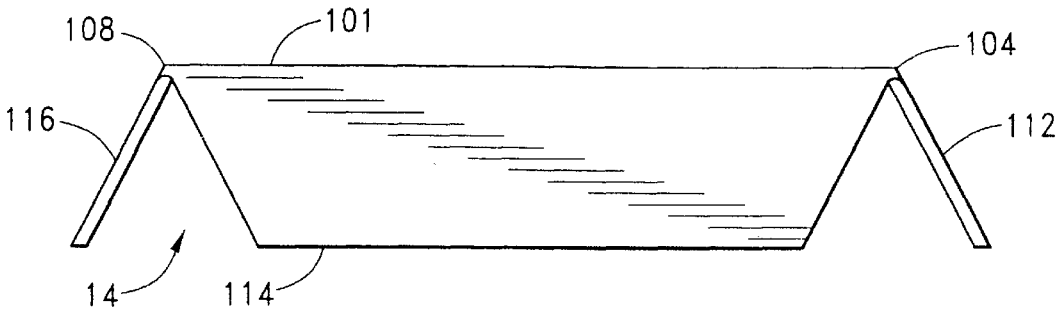
FIG. 9 is a side view of FIG. 8.

Referring to FIGS. 8 and 9, top cover plate 14 comprises plane surface 101 bounded by edges 102, 104, 106 and 108. Skirts 110, 112, 114 and 116 are attached to and flair, that is, extend outwardly and downwardly, from edges 102, 104, 106 and 108. Hole 118 penetrates surface 101 of top cover plate 14. The center of hole 118 is in alignment with the axis of fixture 2. As seen in FIGS. 2 and 5, threaded bolt 120 passes through hole 118, hub 98 and nut 100. The threads of bolt 120 are sized to match the threads of nut 100. The diameter of head 122 of bolt 120 is larger than the diameter of hole 118.

Top cover plate 14, as shown in FIGS. 1 and 2, is adapted to completely cover the top surface of top bracket 12, the top surfaces of display panels 16, 26, 32 and 38 and the top surfaces of mounting rails 6*a*, 6*b*, 6*c* and 6*d*. Accordingly, display panels positioned in rails 6 of fixture 2 can be secured therein by positioning cover plate 14 as described and shown, passing bolt 120 through hole 118 and hub 98 and then threading bolt 120 into nut 100.

It has been found that a fixture of this invention specifically useful to display T-shirts, whereby the designs on the shirts are fully visible, has a cross section in the form of a regular polygon having four sides, a display width of about 14.25 inches and a display height of about 45.5 inches, wherein the flange lengths are about 0.75 inches, the web lengths are about 1.0 inch and the panel is a hardboard, such as Masonite, having a thickness in the range of from about ⅛ to about ¼ of an inch. The diameter of the fixture is thus about 20.2 inches and the interior angle and the tangent angle are each 45 degrees. The fixture contains 12 display spaces having a total display area of about 2593.5 square inches and occupies a horizontal surface area of about 318.97 square inches. The vertical display efficiency is thus about 8.131.

In the fixture referred to above, 12 T-shirt designs can be simultaneously displayed by fitting a shirt over each one of 12 rectangular display panels each having linear dimensions of about 14.25 by 15.2 inches. Thereafter, three covered panels are placed into each of the four sides of the fixture. The panels are, thus, inserted, in succession, from the top of the fixture and caused to slide therein toward bottom plate 8, wherein the side edges of each panel are situated within the confines of the intersecting flanges and webs of facing T angles, as previously described. Then top cover plate 14 is bolted to top bracket 12 as previously described.

Fixtures, in accordance with this invention, having a diameter of about 20.2 inches which are specifically useful for the display of designs on T-shirts preferably have in the range of 3 to 6 sides. The display widths of such fixtures decrease from about 17.5 to about 10.1 inches and the interior angles increase from about 30 to about 60 degrees. With the display height of the fixtures held constant at about 45.5 inches, the total display area increases from about 2380 to about 2750 square inches and the display efficiency increases from about 7.5 to about 8.6.

Support structure 4 is comprised of horizontal base 124, which contacts a ground surface and vertical spindle 127, which rotatably supports fixture 2. In one preferred embodiment, horizontal base 124 is comprised of horizontal legs 126*a*, 126*b*, 126*c* and 126*d* which are equal in length and which are rigidly attached, such as by welding, each to the other at their proximal ends, whereby the distal end of each leg extends substantially perpendicularly outward from the point of attachment 128 at 90 degree intervals.

It is preferred that the distance between the distal ends of oppositely extending horizontal legs, such as distal end 130 of leg 126*a* and distal end 132 of leg 126*c*, be at least equal to two times the previously defined radius, r. In this regard, recall that "r," the radius of a circle whose center is axis O of fixture 2, is the sum of the dimensions consisting of the radius of hub 52 to its outer surface, the length of radial arm 54*a*, and the length of web 44/46, as measured from the interior facing surface 70 to the interior facing surfaces 72 and 74 of flanges 48 and 50, respectively.

Spindle 127 is perpendicular and rigidly connected, such as by welding, to horizontal base 124 at point of attachment 128. Spindle 127, preferably a hollow, circular, cylinder, extends upwardly from point 128 along the axis of fixture 2 and has a sufficiently small outside diameter to permit it to slide within the hollow interiors of cylinder 84 and hub 52.

Collar 130 is slidably fitted around the exterior surface of spindle 127 and is positioned on spindle 127 between surface 80 of bottom cover plate 8 and the bottom surface of hub 52. Collar 132 is slidably fitted around the exterior surface of spindle 127 and is positioned on spindle 127 above the top surface of hub 52. Collar 130 consists of circular cylinder 134 having attached to the top surface thereof flange 136 which is adapted to rotatably contact the bottom surface of hub 52. Collar 132 consists of circular cylinder 138 having attached to the bottom surface thereof flange 140 which is adapted to rotatably contact the top surface of hub 52.

Pin 142 passes through aligned radial holes, not shown, drilled through the walls of cylinder 138 and spindle 127, respectively. Pin 144 passes through aligned radial holes, not shown, drilled through the walls of cylinder 134 and spindle 127, respectively. Accordingly, the combination of pin 144, collar 130 and spindle 127 operates to rotatably support fixture 2 in a vertical position above horizontal base 124. Also, the combination of pin 142, collar 132 and spindle 127 operates to retain spindle 127 within the limits of hub 52 and cylinder 84.

From the above it is obvious that fixture 2 is not stationary and that it is vertically and rotatably supported by stationary support structure 4, wherein fixture 2 is specifically rotatable about spindle 127 by contact between flange 136 of collar 130 and hub 52 of combination hub and vertical support bracket 10. It is further evident that the interaction of hub 52, cylinder 84 and spindle 127 cooperate to maintain the stability of fixture 2 while it is being vertically supported and while it rotates about spindle 127.

The above description of fixture 2 has been limited to it being placed in a position vertical to a horizontal surface. Fixture 2 is also believed to be operable when placed in a position horizontal to a horizontal surface. The same conditions previously described apply except that the area projected by the fixture on the horizontal surface is the product of display height and fixture diameter. Accordingly, a decision to position the fixture vertically or horizontally would include a comparison of vertical display efficiency with horizontal display efficiency. For example, the fixture described above having a vertical display efficiency of about 8.131 has a horizontal display efficiency of about 2.838. The ratio of vertical to horizontal display efficiency is therefore about 2.875 which indicates, with efficiency being the sole criteria, that the fixture should be positioned vertically.

Horizontal positioning of the fixture is indicated when the mentioned ratio of vertical to horizontal display efficiency is less than one. In this regard, in a fixture of constant display width of about 14.25 inches and constant display height of about 45.5 inches, the ratio of vertical to horizontal display efficiency decreases from about 1.052 to about 0.973 when the number of sides of the fixture increases from 12 to 13. With the increase in the number of sides the interior angle increases from 75 to about 76.2 degrees, the fixture diameter increases from about 55.1 to about 59.5 inches and the total display area increases from about 7780 to about 8429 square inches.

EXAMPLE I

The various relationships between the number of sides, the width of each side, the radius, the relevant angles, the display area provided and the floor area occupied by the fixture of this invention can be mathematically illustrated in connection with FIG. 10, a drawing of a regular hexagon. For purposes of this invention, a polygon is defined as a closed plane figure bounded by straight lines, referred to as sides, wherein the sides of a regular polygon are equal in length. Thus, a regular hexagon is a polygon having six sides of equal length. For purposes of the invention, and the mathematical relationships set out below, the length of each side of the polygon is referred to as the width of the display area of the fixture and the length of the display area of the fixture is referred to as the height of the display area of the fixture, or more simply, the height of the fixture.

Accordingly, the six points, A, B, C, D, E and F, of the hexagon, referred to as vertices, when connected by the lines AB, BC, CD, DE, EF and FA, define the six sides, "N," of the hexagon, wherein the length of each side, N, is defined herein as "W." Lines which extend from a vertex to the center, O, of the polygon, are equal in length and define six radials ,AO, BO, CO, DO, EO and FO. The length of each radial is defined herein as "r." As mentioned, each side, N, is equal in length to every other side, and, further, each side, N, subtends a "central angle," "a," which is the acute angle formed at the intersection of adjacent radials, such as AO and BO, at the center, O, of the polygon. Each central angle, a, is equal in size to every other central angle, and the size of each central angle, a, is equal, in degrees, to the total number of degrees in a circle, 360, divided by the number of sides in the regular polygon, that is, a=360/N.

Each radial and each side form an "interior angle," "c," which is the acute angle formed at the intersection of a radial, such as FO, and a side, such as FA, at a vertex, such as point F. Furthermore, lines drawn tangent to a circle of radius, r, such as lines GA and GF, at a vertex of the hexagon, such as points A and F, intersect with a side, such as FA, to form an acute angle, "d," which is defined herein as a "tangent angle." It is obvious that such tangent lines are perpendicular to a radial of the hexagon. That is, tangent line GA is perpendicular to radial AO at vertex A.

Line Go bisects side FA at point I and bisects central angle, a, to thereby form two equal line segments FI and AI and two equal angles "b," that is, b=a/2=180/N.

The net result of the above described geometry is the identification of six distinct, similar, right triangles per side of the regular polygon. In the above case the side involved is line FA and the right triangles are: GAO, GFO, FIG, AIG, FIO and AIO.

Recognition of the named six similar, right triangles enables the following observations which are of particular importance to the design and the utility of the fixture of this invention. Namely, the sum of each interior angle and its adjacent tangent angle is 90 degrees, that is, c+d=angle GFO=90. Furthermore, since angle b and interior angle c are complimentary and, thus, their sum is 90, it follows that angle b is equal to tangent angle d. As was previously described in connection with FIGS. 3 and 4, the cooperation of facing angles at each end of a side N, that is, the combination of an interior angle and its adjacent tangent angle which faces another such combination of angles along opposite edges of the fixture, such as at vertices F and A of side FA, plays the critical role in the ability of the fixture of this invention to maintain and support display panels without the need of any mechanical fastening devices of any sort.

The sine of angle b is equal, for example, to the ratio of line segment FI to radial FO (FI/FO). Accordingly, for purposes of the fixture of this invention, angle b is defined as the "sine angle." Line segments FI and AI are equal to one half of the length of side FA, that is, FI=AI=W/2. Therefore, the sine of angle b, is equal to one-half the ratio of the length of the side of a regular polygon to its radius, that is, sin b=0.5 W/r. Furthermore, due to the similarity of the mentioned right At triangles, the cosine of interior angle c and the sine of tangent angle d are each equal to sin b. Thus, d=a/2=180/N and sin d=0.5 W/r=cos c.

In view of the above definitions and relationships, it is evident that:

$$(0.5\ W/r)=\sin(180/N) \text{ or } W/r=2\sin(180/N) \quad (1)$$

In other words, the ratio of the length of the side of a regular polygon to the radius of the polygon is equal to two times the sine of the ratio of 180 to the number of sides of the polygon.

If the fixture of this invention is employed in a vertical relationship to a horizontal surface area, such as a floor area as shown, for example, in FIGS. 1 and 2, then an important consideration in the design of the fixture is the area of the regular polygon, defined herein as "K1," which is projected on the horizontal surface. For purposes of this invention, the projected area is equal to the area of a circle having the radius, r. Accordingly:

$$K1=\pi r^2 \tag{2}$$

By application of the defined identities and known mathematical steps, equations (1) and (2) can be used by a person to help select, design and make a fixture of this invention which is consistent with a desired number of sides, or with a desired radius or with a desired side width or with a desired angle, such as an interior angle, or with a desired horizontal projection or with some combination thereof.

The above discussion has been limited to a plane, i.e., a two dimensional, figure. The fixture of this invention is, of course, a three dimensional figure. Accordingly, an element of height, H, is required in order to produce a display area per side, defined herein as "K2," which is the product of display height, H, and side width, W, that is, K2=(H)(W). It follows, then, that the total surface area provided by the fixture of this invention for display, defined herein as "K3," is the product of the number of sides of the fixture and the display area per side, that is:

$$K3=(N)\ (K2)=(N)\ (H)\ (W) \tag{3}$$

One of the advantages of the fixture of this invention is the ability to obtain a display efficiency, previously defined as the ratio of the display area provided by the fixture to the horizontal floor area occupied by the fixture, of virtually any desired value, including values greater than one. Accordingly, if the fixture is employed in a vertical relationship to a horizontal surface area, then vertical display efficiency, defined herein as "Rv," is the ratio of K3 to K1. That is:

$$Rv=K3/K1 \tag{4}$$

Thus, if fixture radius, height and the number of display sides is of importance to a user, then, upon substitution of the defined relationships and solving, the vertical display efficiency is:

$$Rv = \frac{(N)(H)2\sin(180/N)}{\Pi r} \tag{5}$$

However, if fixture width, height and the number of display sides is of importance to a user, then, upon substitution of the defined relationships and solving, the vertical display efficiency is:

$$Rv = \frac{(N)(H)4[\sin(180/N)]^2}{\Pi W} \tag{6}$$

It is evident from the above equations that the value of the variables N, H, W and r can be manipulated to produce a fixture having any desired vertical display efficiency ranging from a value of less than one to a value of greater than one.

In view of equation (1), it is to be understood that the value of vertical display efficiency, Rv, for a given number of sides, a specified display height and a specified radius or a specified display width will be the same whether calculated by employing equation (5) or by employing equation (6).

It is still further evident, from a consideration of equations (5) and (6), that change in display efficiency caused by change in the number of sides at constant values of H and W, or at constant values of H and r can be evaluated by omitting the ratio of height to radius, H/r, in equation (5) and by omitting the ratio of height to width, H/W, in equation (6). Accordingly, $$\Delta Rv1=Rv(r/H)=[2/\pi][N][\sin(180/N)] \tag{7}$$

and $$\Delta Rv2=Rv(W/H)=[4/\pi][N][\sin(180/N)]^2 \tag{8}$$

The above derived equations for the calculation of vertical display efficiency are based on the fixture of this invention being positioned in a vertical relationship with respect to a horizontal surface. The fixture, however, also operates when positioned in a horizontal relationship with respect to a horizontal surface. In this regard the total surface area available for display does not change, that is:

$$K3=(N)\ (K2)=(N)\ (H)\ (W) \tag{3}$$

However, if the fixture of this invention is positioned in a horizontal relationship with respect to a horizontal surface area, such as a floor area, then an important consideration in the design of the fixture is the area of the regular polygon, defined herein as "K4," which is projected on the horizontal surface. For purposes of this invention, the projected area is equal to the previously defined "height" of the fixture multiplied by the diameter of the polygon. Accordingly:

$$K4=2rH \tag{9}$$

and the horizontal display efficiency is, thus, the ratio of the total display area to the projected surface area $$Rh=K3/K4 \tag{10}$$

Upon substitution of the defined relationships and solving, the horizontal display efficiency is:

$$Rh=N\sin(180/N) \tag{11}$$

If, for the sole purpose of determining the greatest display efficiency, it becomes of importance to evaluate whether to position the fixture vertically or horizontally, then the ratio of horizontal projected area, K4, to vertical projected area, K1, i.e. K4/K1, referred to herein as the fixture position ratio, can be employed to make the determination. In this regard, the fixture position ratio will be equal to, less than or greater than one. Accordingly, if the ratio is less than one, then the fixture should be placed in a horizontal position to maximize display efficiency. However, if the ratio is greater than one, then the fixture should be placed in a vertical position to maximize display efficiency.

The fixture position ratio can also be determined by dividing vertical display efficiency, Rv, by horizontal display efficiency, Rh. Accordingly, dividing equation (5) by equation (11) produces the result:

$$Rv/Rh=2H/\pi r \tag{12}$$

By setting equation (12) equal to one and solving for r, one obtains the result, $r=2H/\pi$, which can be further reduced to reveal that r is approximately equal to 0.63662 H. Thus, if the radius, r, of the fixture is less than about 63.662% of its display height, H, then the fixture position ratio, K4/K1, is greater than one and the fixture should be positioned vertically to maximize display efficiency. However, if the radius, r, of the fixture is greater than about 63.662% of its display height, H, then the fixture position ratio, K4/K1, is less than one and the fixture should be positioned horizontally to maximize display efficiency.

EXAMPLE II

Thirteen regular polygons, having the number of sides per polygon ranging from 3 to 15, were mathematically evaluated as potential cross-sections of fixtures useful in accordance with this invention. The evaluations were conducted, employing the relationships disclosed in Example I to determine the changes in central angle, sine angle, interior angle, tangent angle and the sine of the sine angle caused by change in the number of sides. The results of the evaluation are provided in Table 1.

TABLE 1

Figure 10:
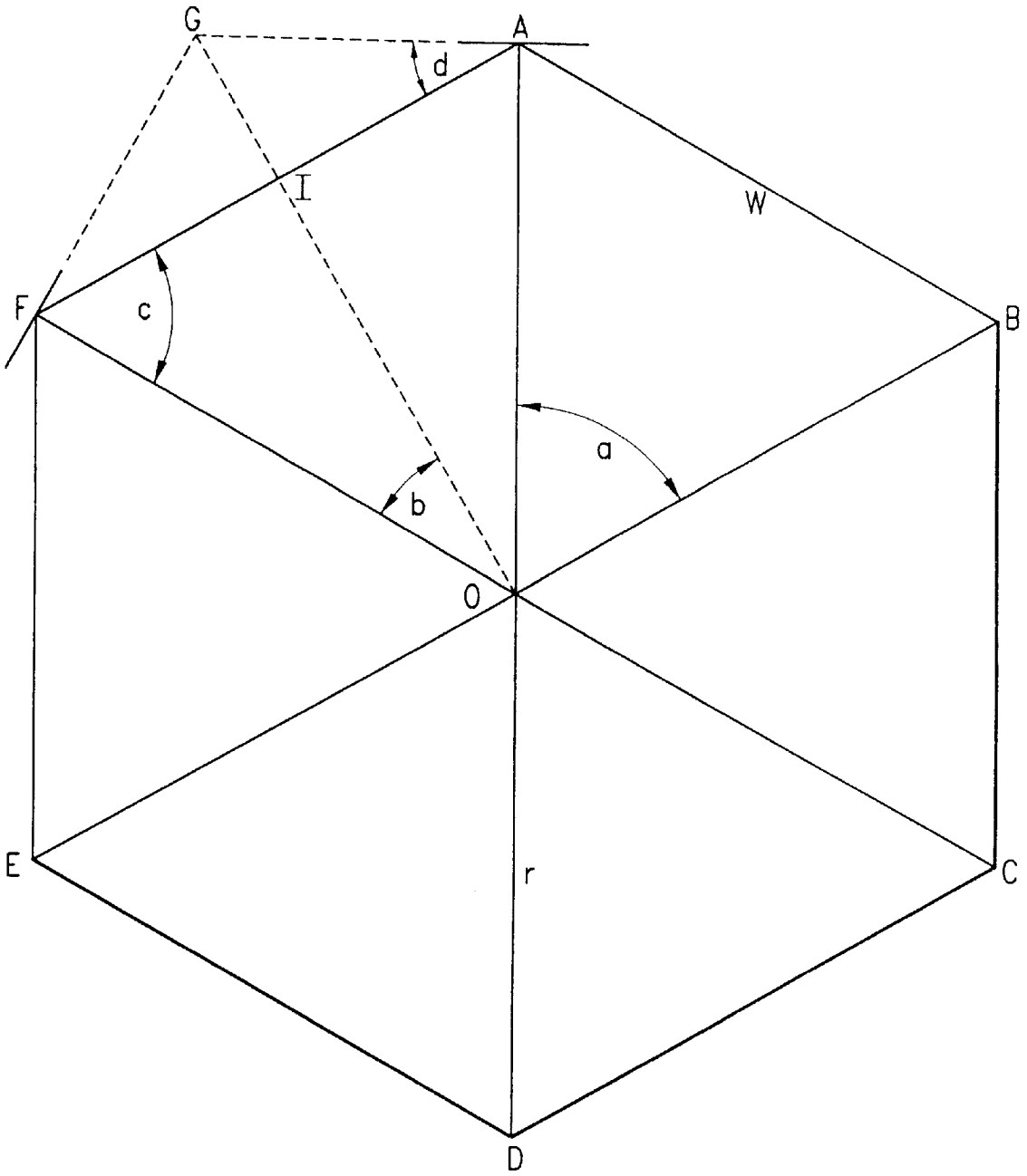
FIG. 10 is a regular hexagon showing, in illustrative schematic format, the critical angles and dimensions involved in the design of the fixture of this invention.

RELATIONSHIP BETWEEN NUMBER OF SIDES IN REGULAR POLYGON AND ANGLES AS SHOWN IN FIG. 10

| (1) NUMBER OF SIDES N | (2) ANGLE (degrees) CENTRAL a | (3) SINE b | (4) INTERIOR c | (5) TANGENT d | (6) Sin b |
|---|---|---|---|---|---|
| 3 | 120.000 | 60.000 | 30.000 | 60.000 | 0.866 |
| 4 | 90.000 | 45.000 | 45.000 | 45.000 | 0.707 |
| 5 | 72.000 | 36.000 | 54.000 | 36.000 | 0.588 |
| 6 | 60.000 | 30.000 | 60.000 | 30.000 | 0.500 |
| 7 | 51.429 | 25.714 | 64.286 | 25.714 | 0.434 |
| 8 | 45.000 | 22.500 | 67.500 | 22.500 | 0.383 |
| 9 | 40.000 | 20.000 | 70.000 | 20.000 | 0.342 |
| 10 | 36.000 | 18.000 | 72.000 | 18.000 | 0.309 |
| 11 | 32.727 | 16.364 | 73.636 | 16.364 | 0.282 |
| 12 | 30.000 | 15.000 | 75.000 | 15.000 | 0.259 |
| 13 | 27.692 | 13.846 | 76.154 | 13.846 | 0.239 |
| 14 | 25.714 | 12.857 | 77.143 | 12.857 | 0.223 |
| 15 | 24.000 | 12.000 | 78.000 | 12.000 | 0.208 |

With respect to Table 1, note that the size of interior angle c increases with increase in the number of sides of the regular polygon.

EXAMPLE III

The thirteen regular polygons of Example II were mathematically evaluated as fixtures useful in accordance with this invention. The evaluations were conducted, with the fixtures positioned vertical to a horizontal surface and compared with the fixtures positioned horizontal to a horizontal surface to determine the relative effect on display efficiency with change in the number of sides while maintaining the ratio of height to radius constant. The results of the evaluation are provided in Table 2.

TABLE 2

RELATIONSHIP BETWEEN NUMBER OF SIDES IN REGULAR POLYGON AND VALUES AS SHOWN IN FIG. 10

| (1) N | (2) Rh | (3) Rv(r/H) | (4) Rv | (5) W | (6) K3 | (7) H/W | (8) Rv(W/H) | (9) Rv | (10) Rv/Rh |
|---|---|---|---|---|---|---|---|---|---|
| 3 | 2.598 | 1.654 | 7.469 | 17.453 | 2382.281 | 2.607 | 2.865 | 7.469 | 2.875 |
| 4 | 2.838 | 1.801 | 8.131 | 14.250 | 2593.500 | 3.193 | 2.546 | 8.131 | 2.875 |
| 5 | 2.939 | 1.871 | 8.449 | 11.845 | 2694.821 | 3.841 | 2.199 | 8.449 | 2.875 |
| 6 | 3.000 | 1.910 | 8.624 | 10.076 | 2750.822 | 4.516 | 1.910 | 8.624 | 2.875 |
| 7 | 3.037 | 1.934 | 8.731 | 8.744 | 2784.919 | 5.204 | 1.678 | 8.731 | 2.875 |
| 8 | 3.061 | 1.949 | 8.801 | 7.712 | 2807.184 | 5.900 | 1.492 | 8.801 | 2.875 |
| 9 | 3.078 | 1.960 | 8.849 | 6.893 | 2822.509 | 6.601 | 1.340 | 8.849 | 2.875 |
| 10 | 3.090 | 1.967 | 8.883 | 6.227 | 2833.502 | 7.306 | 1.216 | 8.883 | 2.875 |
| 11 | 3.099 | 1.973 | 8.909 | 5.678 | 2841.652 | 8.014 | 1.112 | 8.909 | 2.875 |
| 12 | 3.106 | 1.977 | 8.928 | 5.216 | 2847.860 | 8.723 | 1.023 | 8.928 | 2.875 |
| 13 | 3.111 | 1.981 | 8.943 | 4.823 | 2852.697 | 9.434 | 0.948 | 8.943 | 2.875 |
| 14 | 3.115 | 1.983 | 8.956 | 4.484 | 2856.539 | 10.146 | 0.883 | 8.956 | 2.875 |
| 15 | 3.119 | 1.985 | 8.965 | 4.190 | 2859.640 | 10.859 | 0.826 | 8.965 | 2.875 |

NOTE: In Table 2, the height, H, of the fixture was held constant at 45.5 inches and the radius, r, of the fixture was held constant at 10.076 inches. Accordingly, the ratio of height to radius, H/r, was a constant value of 4.516, the floor area, K1, projected by the fixture, when positioned vertically, was a constant value of 318.970 square inches, the floor area, K4, projected by the fixture, when positioned horizontally, was a constant value of 916.941 square inches and, therefore, the fixture position ratio, K4/K1, was a constant value of 2.875.

In Table 2, horizontal display efficiency, Rh (column 2), was calculated by employing equation (11) of Example I and t2 vertical display efficiency, Rv, was independently calculated by employing each of equation (5) (column 4) and equation (6) (column 9) of Example I. In this regard, observe that the results recorded in columns 4 and 9 are identical. Fixture side width, W (column 5), was calculated by employing equation (1) of Example 1.

With respect to Table 2 note, in column 10, that the ratio of vertical display efficiency, Rv, to horizontal display efficiency, Rh, the fixture position ratio, is constant and that vertical display efficiency and total display area, K3, experience a small total increase of about 20% with increase in the number of sides of the fixture from 3 to 15. However, this relative stability must be contrasted with the simultaneous sharp total increase of about 316.5% in the ratio of height to width and sharp total decrease of about 76% in display width with increase in the number of sides of the fixture from 3 to 15.

With the above observations in mind it seems clear that a user, desiring to focus on the constant radius and height values employed in this Example III, can, accordingly, position the fixture vertically to maximize display efficiency and base a use decision on considerations of side width (and, therefor, on the number of sides and/or interior angle) without facing significant change in display efficiency. Since vertical display efficiency and total display area each vary directly with increase in the number of sides of the fixture, the basic use decision is reduced to a balancing of interests based upon side width versus interior angle which vary indirectly.

EXAMPLE IV

The thirteen regular polygons of Example II were mathematically evaluated as fixtures useful in accordance with this invention. The evaluations were conducted, with the fixtures positioned vertical to a horizontal surface and compared with the fixtures positioned horizontal to a horizontal surface to determine the relative effect on display efficiency with change in the number of sides while maintaining the ratio of height to width constant. The results of the evaluation are provided in Table 3.

TABLE 3

RELATIONSHIP BETWEEN NUMBER OF SIDES IN REGULAR POLYGON AND VALUES AS SHOWN IN FIG. 10

| (1) N | (2) Rh | (3) Rv(W/H) | (4) Rv | (5) r | (6) K3 | (7) H/r | (8) Rv(r/H) | (9) Rv | (10) Rv/Rh | (11) K1 | (12) K4 | (13) K4/K1 |
|---|---|---|---|---|---|---|---|---|---|---|---|---|
| 3 | 2.598 | 2.865 | 9.147 | 8.227 | 1945.125 | 5.530 | 1.654 | 9.147 | 3.521 | 212.647 | 748.679 | 3.521 |
| 4 | 2.838 | 2.546 | 8.131 | 10.076 | 2593.500 | 4.516 | 1.801 | 8.131 | 2.875 | 318.970 | 916.941 | 2.875 |
| 5 | 2.939 | 2.199 | 7.023 | 12.122 | 3241.875 | 3.754 | 1.871 | 7.023 | 2.390 | 461.617 | 1103.081 | 2.390 |
| 6 | 3.000 | 1.910 | 6.098 | 14.250 | 3890.250 | 3.193 | 1.910 | 6.098 | 2.033 | 637.940 | 1296.750 | 2.033 |
| 7 | 3.037 | 1.678 | 5.357 | 16.421 | 4538.625 | 2.771 | 1.934 | 5.357 | 1.764 | 847.174 | 1494.352 | 1.764 |
| 8 | 3.061 | 1.492 | 4.763 | 18.619 | 5187.000 | 2.444 | 1.949 | 4.763 | 1.556 | 1089.031 | 1694.286 | 1.556 |
| 9 | 3.078 | 1.340 | 4.280 | 20.832 | 5835.375 | 2.184 | 1.960 | 4.280 | 1.390 | 1363.378 | 1895.722 | 1.390 |
| 10 | 3.090 | 1.216 | 3.882 | 23.057 | 6483.750 | 1.973 | 1.967 | 3.882 | 1.256 | 1670.148 | 2098.186 | 1.256 |
| 11 | 3.099 | 1.112 | 3.550 | 25.290 | 7132.125 | 1.799 | 1.973 | 3.550 | 1.145 | 2009.303 | 2301.385 | 1.145 |
| 12 | 3.106 | 1.023 | 3.268 | 27.529 | 7780.500 | 1.653 | 1.977 | 3.268 | 1.052 | 2380.823 | 2505.129 | 1.052 |
| 13 | 3.111 | 0.948 | 3.027 | 29.772 | 8428.875 | 1.528 | 1.981 | 3.027 | 0.973 | 2784.693 | 2709.288 | 0.973 |
| 14 | 3.115 | 0.883 | 2.818 | 32.019 | 9077.250 | 1.421 | 1.983 | 2.818 | 0.905 | 3220.905 | 2913.771 | 0.905 |
| 15 | 3.119 | 0.826 | 2.636 | 34.269 | 9725.625 | 1.328 | 1.985 | 2.636 | 0.845 | 3689.451 | 3118.512 | 0.845 |

NOTE: In Table 3 the height, H, of the fixture was held constant at 45.5 inches and the width, W, of the fixture was held constant at 14.250 inches. Accordingly, the ratio of height to width, H/W, was a constant value of 3.193, the floor area, K1, projected by the fixture, when positioned vertically, was not a constant value and varied from a low of 212.647 to a high of 3689.451 square inches, the floor area, K4, projected by the fixture, when positioned horizontally, was a not constant value and varied from a low of 748.679 to a high of 3118.512 square inches and, therefor, the fixture position ratio, K4/K1, was not a constant value and varied from a high of 3.521 to a low of 0.845.

In Table 3, horizontal display efficiency, Rh (column 2), was calculated by employing equation (11) of Example I and vertical display efficiency, Rv, was independently calculated by employing each of equation (6) (column 4) and equation (5) (column 9) of Example I. In this regard, observe that the results recorded in columns 4 and 9 are identical. Fixture radius, r,(column 5), was calculated by employing equation (1) of Example 1.

With respect to Table 3 note, in column 10, that the ratio of vertical display efficiency, Rv, to horizontal display efficiency, Rh, i.e., the fixture position ratio, is not constant and that it experiences a sharp decrease of about 76% and varies from a value greater than one to a value less than one with increase in the number of sides from 3 to 15, wherein the change from greater than one to less than one occurs when the number of sides increase from 12 to 13. Also note that total display area, K3, and radius, r, each experience sharp increases of about 400% and 76%, respectively, with increase in the number of sides of the fixture from 3 to 15. However, these sharp increases must be contrasted with the simultaneous sharp decreases in vertical display efficiency and ratio of height to radius of about 71% and 76%, respectively. With the above observations in mind it seems clear that a user, desiring to focus on the constant width and height values employed in this Example IV, must remain very alert to sharp changes in all the interacting variables, including the vertical or horizontal position of the fixture, when making decisions concerning the number of sides of the fixture. Comparing the opposite changes in direction of display area, column 6, and display efficiency, column 4, with increase in number of sides reduces the decision to a balancing of interests for each particular use situation.

Having thus described the invention that which is claimed is:

1. An article of manufacture comprised of a base structure and a display structure;

said base structure is a first three dimensional figure comprised of a ground contact member and a spindle member wherein said spindle member is perpendicularly and rigidly attached to and extends upwardly from said ground contact member and further wherein said spindle member is adapted to axially and rotatably support said display structure;

said display structure is a second three dimensional figure and has a longitudinal axis, an interior and an exterior and provides a plurality of rectangular planar areas at said exterior useful to display goods, wherein a transverse cross section of said display structure through said planar areas produces a geometrical shape of a regular polygon, said display structure is comprised of a bottom plate, a top bracket, an intermediate support bracket, positioned between said bottom plate and said top bracket, and a number of elongated mounting rail members of equal length, said number being at least 3 and no more than 15, wherein each of said mounting rail members has an upper end and a lower end, further wherein each of said rail members has a "T" shaped cross section consisting of two flanges and a web, and still further wherein a "T" angle is formed between said web and each of said flanges, said bottom plate, said top bracket and said intermediate support bracket are positioned in parallel in said display structure, wherein said bottom plate has vertices equal in number to said number of said rail members, said top bracket has vertices equal in number to said number of said rail members and said intermediate support bracket has vertices equal in number to said number of said rail members and further wherein said bottom plate vertices, said top bracket vertices and said intermediate support bracket vertices are in alignment at said exterior of said display structure, each of said mounting rail members is perpendicular to said bottom plate, said top bracket and said intermediate support bracket, wherein said lower end of each of said mounting rail members is rigidly attached to said bottom plate at one of said bottom plate vertices, said upper end of each of said mounting rail members is rigidly attached to said top bracket at one of top bracket vertices and each of said mounting rail members is rigidly attached to said intermediate support bracket at one of said intermediate support bracket vertices and further wherein said web of each of said mounting rail members faces the interior of said display structure along a radial line extending from the longitudinal axis of said display structure, whereby each of said rail members is disposed in a fixed position at said exterior of said display structure, is parallel to and equidistant from said longitudinal axis, is perpendicular to a plane of said polygon, and at an equally spaced distance from any of said rail members immediately adjacent thereto, and further whereby one of said "T" angles of one of said rail members-faces one of said "T" angles of an immediately adjacent rail member to thereby form two opposite sides of one of said rectangular planar areas which is adapted to hold and visually display goods.

2. The article of claim 1 wherein a first opening is formed in said bottom plate, wherein an axis of said first opening is coincident with said longitudinal axis of said display structure.

3. The article of claim 2 wherein each of said rectangular planar areas is bounded by said bottom plate between said lower ends of said immediately adjacent rail members.

4. The article of claim 3 wherein said intermediate support bracket is comprised of a first hollow hub having an axis which is coincident with said longitudinal axis of said display structure, and a plurality of middle radial arms equal to said number of said rail members, each of said middle radial arms is equal in length and has a distal end and a proximal end, wherein said proximal end of each of said middle radial arms is rigidly attached to said first hub and each of said middle radial arms extends perpendicularly outward from said first hub to said distal end of said middle radial arm which is rigidly attached to said web of one of said rail members.

5. The article of claim 4 wherein said middle radial arms attached to said first hub are equal in length and lie in a plane parallel to said bottom plate.

6. The article of claim 5 wherein said first hub is a truncated circular cylinder.

7. The article of claim 6 wherein said top bracket is comprised of a second hollow hub having an axis which is coincident with said longitudinal axis of said display structure, and a plurality of upper radial arms equal to said number of said rail members, each of said upper radial arms is equal in length and has a distal end and a proximal end, wherein said proximal end of each of said upper radial arms is rigidly attached to said second hub and each of said upper radial arms extends perpendicularly outward from said second hub to said distal end of said upper radial arm which is rigidly attached to said web of one of said rail members.

8. The article of claim 7 wherein said upper radial arms attached to said second hub are equal in length and lie in a plane parallel to said bottom cover plate.

9. The article of claim 8 wherein said second hub is a truncated circular cylinder.

10. The article of claim 9 wherein a top cover plate, having a second opening formed therein, covers said upper end of each of said rail members, wherein the axis of said second opening is coincident with said longitudinal axis of said display structure.

11. The article of claim 10 wherein said top cover plate lies in a plane parallel to said upper radial arms and is removably attached to said display structure by a fastener passing through said second opening and said second hub.

12. The article of claim 11 wherein said spindle member passes through said first opening and said first hub and is adapted to vertically and rotatably support said display structure from a point immediately below said first hub.

13. The article of claim 12 wherein said number of said mounting rail members in said display structure is at least 3 and no more than 6.

14. The article of claim 13 wherein said number of said mounting rails is 4, said equally spaced distance is 14.25 inches and said equal length of said mounting rails is 45.5 inches.

15. The article of claim 13 wherein at least one display panel is inserted between said facing "T" angles of said immediately adjacent mounting rail members in each of said planar areas.

16. A display fixture for holding and visually displaying goods, whose transverse cross section is a regular polygon, a longitudinal axis, said fixture having an interior and an exterior and at least three elongated edges, wherein each of said elongated edges is perpendicular to a vertex of said regular polygon, said elongated edges are parallel to each other and each of said elongated edges cooperates with immediately adjacent elongated edges to provide a planar area which is adapted to hold and visually display said goods;

said display fixture is comprised of at least three elongated rail members, at least three radial arms and at least one first hollow hub, said first hollow hub having an axis which is coincident with the longitudinal axis of said display structure, each of said rail members consists essentially of an upper end, a lower end, and a "T" shaped cross section consisting of a web and two flanges whereby a "T" angle of 90° is formed between said web and each of said flanges, each of said rail members is of equal length and is perpendicularly disposed at a vertex of said regular polygon at said exterior of said display structure whereby each of said rail members is equally spaced from any of said rail members immediately adjacent thereto and parallel to and equally spaced from said longitudinal axis of said display structure, each of said radial arms is of equal length and has a distal end and a proximal end wherein each of said radial arms is attached at said proximal end to and extends radially outwardly from said first hollow hub toward a vertex of said regular polygon, said web of each of said rail members is perpendicularly and rigidly attached to said distal end of one of said radial arms, whereby each of said flanges of each of said rail members is perpendicular to said radial arm and said "T" angle faces a "T" angle on an immediately adjacent rail member, and further whereby each one of said rail members is adapted to cooperate with two of said rail members immediately adjacent thereto to thereby form one of said planar areas.

* * * * *